US005403095A

United States Patent [19]

Melk

[11] Patent Number: 5,403,095

[45] Date of Patent: Apr. 4, 1995

[54] FLEXIBLE COOLER WITH REMOVABLE INSERT

[75] Inventor: Thomas Melk, Chicago, Ill.

[73] Assignee: Outer Circle Products, Ltd., Chicago, Ill.

[21] Appl. No.: 226,416

[22] Filed: Apr. 12, 1994

Related U.S. Application Data

[63] Continuation of Ser. No. 120,635, Sep. 13, 1993, abandoned, which is a continuation of Ser. No. 38,548, Mar. 29, 1993, abandoned, which is a continuation of Ser. No. 833,351, Feb. 10, 1992, abandoned.

[51] Int. Cl.[6] ..... B65D 30/10

[52] U.S. Cl. ..... 383/110; 220/410; 220/421

[58] Field of Search ..... 383/110; 220/412, 408, 220/410, 773, 774, 775, 776, 420, 421; 150/901

[56] References Cited

U.S. PATENT DOCUMENTS

| | | | |
|---|---|---|---|
| D. 244,723 | 6/1977 | Rabinowitz . | |
| D. 273,533 | 4/1984 | Weinreb . | |
| D. 299,406 | 1/1989 | Jacober . | |
| 1,639,418 | 8/1927 | Washburn | 150/901 X |
| 1,732,098 | 10/1929 | Lessenhop | 383/110 X |
| 1,762,527 | 6/1930 | Robinson | 383/110 X |
| 1,922,485 | 8/1933 | McKee | 383/110 X |
| 1,949,677 | 3/1934 | Crawford | 383/110 X |
| 2,021,226 | 11/1935 | Davis | 4/455 |
| 2,954,891 | 10/1960 | Imber | 383/110 X |
| 4,085,785 | 4/1978 | Hoot | 220/412 X |
| 4,163,374 | 8/1979 | Moore et al. | 220/412 X |
| 4,282,984 | 8/1981 | Curry, Jr. | 220/776 X |
| 4,375,828 | 3/1983 | Biddison | 383/110 X |
| 4,537,313 | 8/1985 | Workman . | |
| 4,598,746 | 7/1986 | Rabinowitz . | |
| 4,629,040 | 12/1986 | Jones | 220/408 X |
| 4,767,039 | 8/1988 | Jacober . | |
| 4,805,776 | 2/1989 | Namgyal et al. | 383/110 X |
| 4,889,302 | 12/1989 | Tucker | 220/412 X |
| 4,929,094 | 5/1990 | Becker | 383/110 X |
| 5,005,679 | 4/1991 | Hjelle | 383/110 X |

*Primary Examiner*—Allan N. Shoap
*Assistant Examiner*—Jes F. Pascua
*Attorney, Agent, or Firm*—Trexler, Bushnell, Giangiorgi & Blackstone, Ltd.

[57] ABSTRACT

A thermally insulating carrier for preventing temperature change of heated or cooled items placed therein. The carrier includes a flexible bag-like container having a compartment therein and a generally rigid hollow tub-like liner member which is removably disposed in the compartment. The flexible container includes a side wall portion, a base portion, and a displaceable cover. At least the side wall portion and cover are constructed incorporating a flexible insulating material for providing an insulating effect. The side wall portion is joined with the base portion and together with the cover define the compartment. A container aperture is defined by a top edge of the side wall portion. A closing device is attached to the container aperture and a perimeter of the cover for releasably retaining the cover over the container aperture. The hollow liner is integrally formed of a rigid, waterproof, and shatterproof material with side portions joined to a bottom portion. A mouth is formed around the top of the liner and is coincident with the container aperture. The liner improves the thermal characteristics, provides structural support for the flexible container, and prevents leakage of moisture from the flexible container.

5 Claims, 1 Drawing Sheet

Fig. 1
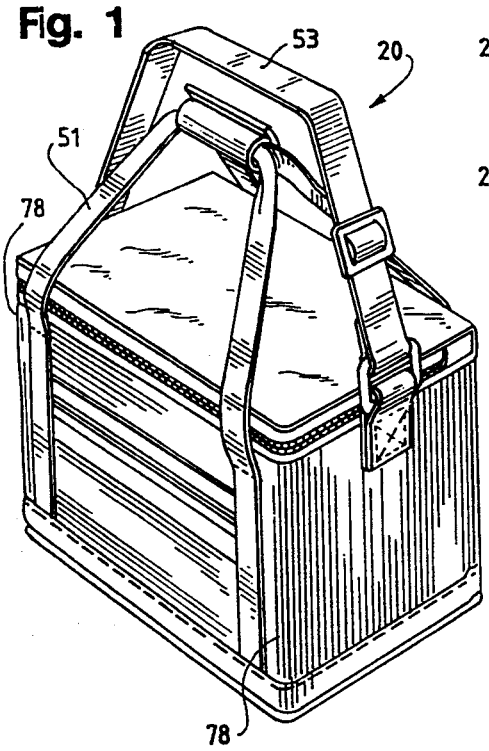
Fig. 2
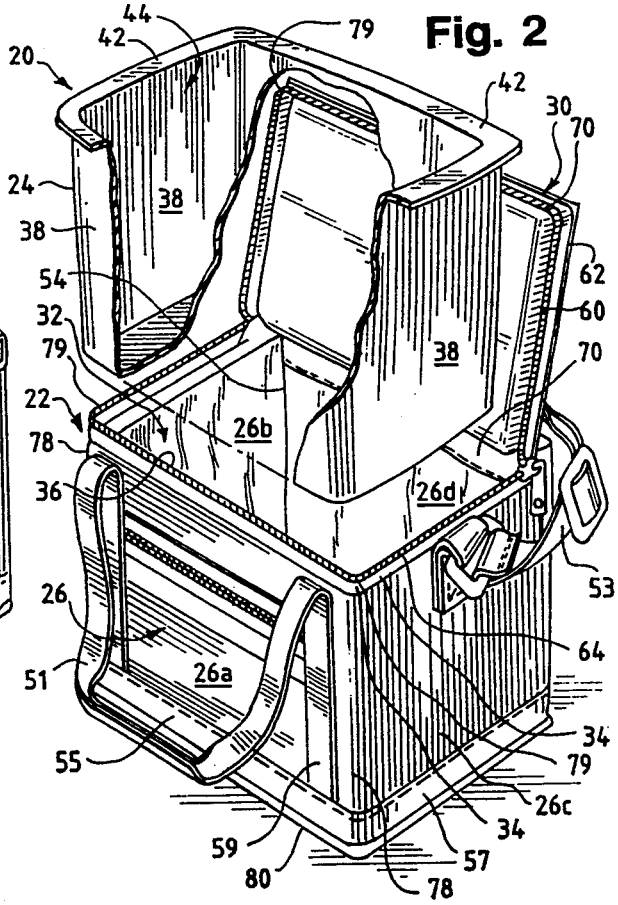
Fig. 3
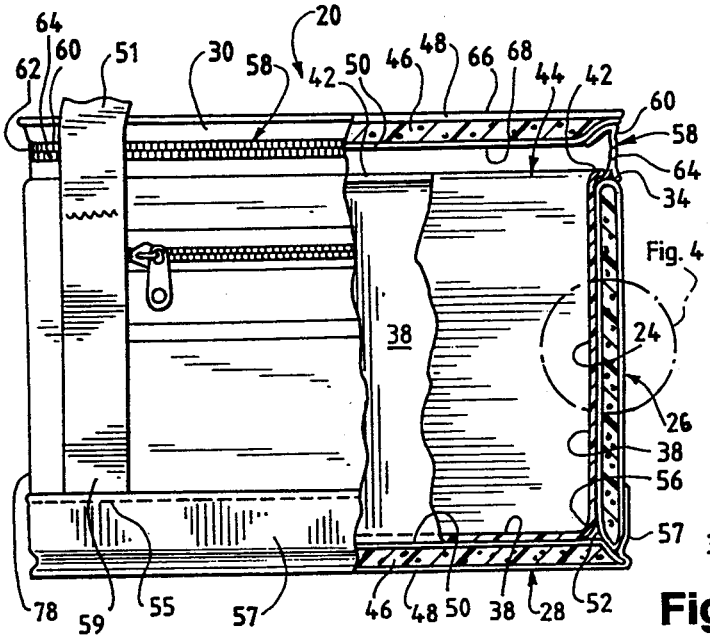
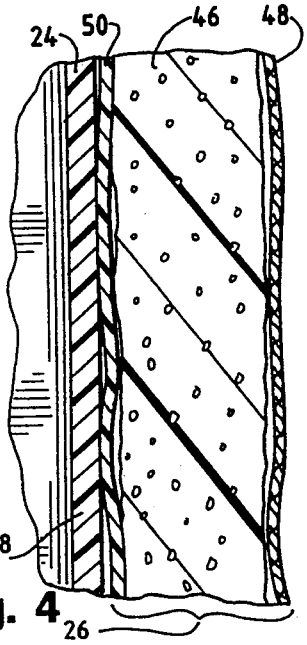
Fig. 4

FLEXIBLE COOLER WITH REMOVABLE INSERT

This application is a continuation of application Ser. No. 08/120,635, filed Sep. 13, 1993, now abandoned, which is a continuation of application Ser. No. 08/038,548, filed Mar. 29, 1993, now abandoned, which is a continuation of application Ser. No. 07/833,351, filed Feb. 10, 1992, now abandoned.

BACKGROUND OF THE INVENTION

The present application pertains to flexible walled coolers or "thermally insulating carriers" for preventing temperature change of heated or cooled items placed in such a carrier.

Portable containers for carrying heated or cooled items such as food or beverages are very popular since they provide the ability to prevent the change in temperature of heated or cooled items over a period of time. Many individuals use such thermally insulated carriers for maintaining the temperature of food and beverages when camping, attending sporting advents or other spectator activities, or any other activity in which refrigeration or heating is not easily accessible or maintainable. Further, such thermally insulating carriers have enjoyed a great deal of popularity in other noncustomary applications such as in medicine where chemicals or various samples must be maintained at a predetermined desired temperature in the absence of electrical or other energized heating or cooling systems.

More recently, softwalled carriers have gained a high degree of popularity with consumers. Softwalled carriers provide several advantages over the standard hardwalled coolers, including lighter weight, greater portability, and greater comfort when transporting such coolers. Softwalled carriers are typically constructed by sandwiching a section of thermally insulating foam between two pieces of flexible fabric. Several pieces of this sandwiched component are stitched together to achieve a desired final shape.

The problem with such softwalled carriers is that they do not provide structural support or waterproofing achieved with the hardwalled coolers. Structural support is desirable in order to provide ease of movement so that the flexible insulating container portion of the carrier does not sag when the carrier is transported. Further, support is necessary to protect the contents of the carrier from being crushed by impact or loads placed on top of the carrier.

Waterproofing is desirable for several reasons. First, when the carrier is used to maintain the temperature of cold items, ice or some other cold medium is used to maintain the cooled temperature. As the ice or other medium melts, water or some other liquid is created which tends to accumulate inside the carrier. Most softwalled carriers tend to leak, as they are sewn together, and the seams become saturated and provide a path for leakage. This leakage may also result in saturation of the thermally insulating material which hinders its ability to provide a thermal barrier.

Another problem with available softwalled carriers is that the construction techniques, such as sewing, result in corner crevices being formed between side wall portions and the base as well as vertical corners where the sidewall portions meet. These crevices accumulate particles and other debris and render cleaning difficult. This is a particular problem when the cooler is used to transport food as the accumulated particles may deteriorate and creating decay and making the carrier rancid.

OBJECTS AND SUMMARY OF THE INVENTION

A general object of the present invention is to provide a portable flexible thermally insulating carrier which is less susceptible to leakage.

Another object of the present invention is to provide a light weight thermally insulating carrier having improved insulating properties.

A further object of the present invention is to provide a flexible thermally insulating carrier which has a soft flexible container portion and a relatively rigid liner member for structurally reinforcing the container portion.

Yet another object of the present invention is to provide a flexible thermally insulating carrier which has a soft flexible container portion and a removable waterproof liner member for promoting the ease of cleaning of the thermally insulating carrier.

Briefly, and in accordance with the foregoing, the present invention comprises a thermally insulating carrier for preventing temperature change of heated or cooled items placed therein. The carrier includes a flexible bag-like container having a compartment therein and a generally rigid hollow tub-like liner member which is removably disposed in the compartment. The flexible container includes a side wall portion, a base portion, and a displaceable cover. At least the side wall portion and cover are constructed incorporating a flexible insulating material for providing an insulating effect. The side wall portion is joined with the base portion and together with the cover define the compartment. A container aperture is defined by a top edge of the side wall portion. A closing device is attached to the container aperture and a perimeter of the cover for releasably retaining the cover over the container aperture. The hollow liner is integrally formed of a rigid, waterproof, and shatterproof material with side portions joined to a bottom portion. A mouth is formed around the top of the liner and is coincident with the container aperture. The liner improves the thermal characteristics, provides structural support for the flexible container, and prevents leakage of moisture from the flexible container.

BRIEF DESCRIPTION OF THE DRAWINGS

The organization and manner of the structure and operation of the invention, together with further objects and advantages thereof, may be understood by reference to the following description taken in connection with the accompanying drawings, wherein like reference numerals identify like elements, and in which:

FIG. 1 is a perspective view of a thermally insulating carrier of the present invention in which a strap and two handles have been suspended above the carrier to more clearly show the shape and relative dimensions of the carrier;

FIG. 2 is an exploded partial fragmentary perspective view of the thermally insulating carrier in which a liner member has been extracted from a flexible container portion;

FIG. 3 is a partially fragmentary front elevational view of the thermally insulating carrier as taken along line 3—3 in FIG. 1 showing the liner member in side of the flexible container; and FIG. 4 is an enlarged cross sectional view through a wall of the thermally insulating carrier taken along detail 4—4 in FIG. 3 showing the structural composition of the carrier.

DETAILED DESCRIPTION OF THE ILLUSTRATED EMBODIMENT

While the invention may be susceptible to embodiment in different forms, there is shown in the drawings, and herein will be described in detail, a specific embodiment with the understanding that the present disclosure is to be considered an exemplification of the principles of the invention and is not intended to limit the invention to that as illustrated and described herein.

Referring now to the drawings, wherein like parts are designated by the same reference numerals throughout the figures, a thermally insulating carrier 20 in accordance with the present invention is shown in FIG. 1. The thermally insulating carrier 20 includes a flexible container portion 22 and a hollow liner member 24. As shown in FIGS. 1–3, the container portion 22 is formed with a wall portion 26 (having a front 26*a*, left side 26*b*, right side 26*c*, and back 26*d*), a bottom or base portion 28, and a displaceable cover 30. An inner compartment 32 is defined by the inner boundaries of the wall portion 26, base portion 28 and cover portion 30. The compartment 32 is accessible when the cover portion 30 is lifted off of an upper edge 34 of the wall portions 26. With the cover portion 30 displaced as such, a container aperture 36, defined by the upper edges 34 of the wall portions 26, is accessible for inserting and removing items from the carrier 20.

As clearly shown in FIGS. 2 and 3, the hollow plastic liner member 24 is removably insertable through the aperture 36 into the compartment 32. The liner member 24 is integrally formed as a single piece unitary body having a tub-like shape of a suitable material which is water proof, unbreakable or shatter proof, and puncture resistant over a range of temperatures. An example of such a material is polyethylene. Liner sides 38 are integrally formed with a liner base 40. A lip 42 is formed along a top edge of the liner sides 38 and extends slightly away from the liner sides 38. The lip 42 defines the mouth 44 of the liner 24. When the liner 24 is positioned inside of the compartment 32, the mouth 44 is substantially coincident with the container aperture 36.

FIG. 4 provides an enlarged cross-sectional view of the thermally insulating carrier wall as taken along in detail 4—4 in FIG. 3. As shown in the detail of FIG. 4, the wall portion 26 is constructed of a flexible insulating material 46 sandwiched between an outer jacket 48 and an inner water-resistant thermal barrier 50. The outer jacket 48 is a generally abrasion-resistant tough material such as 420 denier nylon. Carrying handles 51 and an adjustable shoulder strap 53 are attached to the outer jacket 48 to provide a means of more easily lifting and transporting the thermally insulating carrier 20. The handles 51 are attached to the base portion 28 by way of stitching 55 extending through an upwardly extending flap 57 and into the webbing of the handle 51. The upwardly extending flap integrates the bottom portion 28 with the wall portions 26*a*, 26*b* and 26*c*. The webbing 59 is positioned on the front side 26*a* and the back 26*d* at two spaced apart locations in a generally parallel orientation. Attachment of the webs 59 to the front side 26*a* and back 26*d* and integration with the bottom 28 by way of stitching, provides a reinforced carrying structure adding strength, stability, and support to the carrier 20.

The flexible insulating material 46 may be anyone of a suitable known insulating material which retains its flexible characteristics over a wide range of temperatures. An example of such a material would be a high density polyurethane foam. The water resistant thermal barrier 50 lining the inside of the compartment 32 is anyone of a number of suitable water-resistant materials. This barrier material 50 must also have suitable flexibility characteristics over a range of temperatures. For example, the flexible insulating material 46 as well as the water-resistant thermal barrier 50 must not crack or melt when exposed to freezing temperatures or near boiling temperatures, respectively.

In the lower right hand corner of the cross-section as shown in FIG. 3, a wall portion 26 abuts the base portion 28. A crevice 52 is formed at the junction of the wall portion 26 and the base portion 28. A common problem with other flexible thermally insulating carriers is that food particles or other particular matter tends to build up in such crevices 52 between the wall portion 26 and the base portion 28. Such a crevice 52 extends around the bottom inside surface of the compartment 32 as well as along the upright corners 54 formed between two adjoining wall portions 26.

In the present invention, the liner sides 36 intersect the liner base 38 at a curved corner 56. The removability of the liner member 24 combined with the curved inside corners 56 and smooth inside surfaces provide for easier cleaning and maintenance of the compartment 32 of the thermally container portion 22. Further, since the lip 42 extends away from the liner sides 36, it partially overlaps the upper edge 34 of the wall portions 26. The lip 42 helps to prevent material or liquid from dropping or flowing between the liner member 24 and the wall portions 26 of the container portion 22.

Another problem with other soft flexible carriers is that they do not provide protection for breakable or delicate items. The present invention overcomes this problem by means of the liner member 24. The liner member 24 provides structural support for the soft flexible container portion 22 without appreciable added weight. The structural support provided by the liner member 24 provides the added degree of protection for delicate or breakable items placed in the carrier 20. The combination of the liner member 24 inside of the flexible container portion 22 provides substantially more resistance to compression, compaction, as well as impact than the insulating container portion 22 without the liner member 24.

The liner member 24 further retards the change in temperature of heated or cooled items retained in the thermal carrier 20. The generally rigid characteristics and generally denser construction of the liner member 24 compared to the water-resistant barrier 50 adds an additional degree of temperature retention.

The liner member 24 provides an added degree of waterproofing as well as insulation. The liner member 24 is waterproof and does not permit water to pass therethrough. As such, any moisture that may accumulate inside the liner member 24 will not pass through to the flexible insulating material 46 which might otherwise potentially become saturated.

In contrast, while some flexible carriers may employ a water-resistant thermal barrier 50, such barrier material 50 is merely water-resistant and not waterproof. For example, if moisture collects inside a container portion 22 without a liner member 24, moisture may seep into the crevices 52 and accumulate. Additionally, if the junction forming the crevice 52 has stitching or sewing to attach the water-resistant barrier to the outer jacket, such stitching may provide passage for moisture from the compartment to be absorbed by the flexible insulating material 46. The present invention overcomes these problems.

Once the liner is inserted into the compartment 32, the cover portion 30 of the flexible carrier 22 may be releasably attached to the container aperture 36 by closing means 58 formed therearound. The closing means or zipper 58 shown in the present invention include a first segment 60 attached to a perimeter 62 of the cover portion 30 and a second zipper segment 64 attached around the container aperture. It should be noted that the second zipper segment 64 is attached to the wall portions 26 at the upper most edge 34 thereof and not at a position partway down the wall portions 26. The first zipper segment 60 is attached at a position generally between a top side 66 and a bottom side 68 of the cover 30.

As shown in FIGS. 1 and 2, the first and second zipper segments 60, 64 only extend around the upper edge of three wall portions 26 and the corresponding perimeter portions 62 of the cover 30. The area between the fourth portion 26 and the cover 30 forms a flexible integral hinge 70. While the closing means 58 as shown in the present embodiment is a zipper type device of known construction, other forms of closing means such as Velcro or a series of discrete fasteners may be employed.

The insulating container portion 22 shown in the present embodiment uses two pieces of material to form the insulating container portion 22. A first piece of material comprised of a left and right wall portion 26*b*, 26*c* and a front wall portion 26*a*. A radiused corner 78 is formed between the front wall 26*a* and the left side wall 26*b* as well as between the front wall 26*a* and the right side wall 26*c*. Since the wall portions 26*a*, 26*b*, and 26*c* are formed from a single piece of material, the areas where the left and right side walls 26*b*, 26*c* are bent away from the front side wall 26*a* forms the radiused corners 78. A second piece is comprised of the base portion 28, a rear wall portion 26*d* and the cover 30. The resulting insulating container portion 22 has a seam which runs along a lower portion 80 of the corresponding wall portions 26*a*, 26*b*, 26*c* and the corresponding edges of the base portion 28. The seam runs vertically up along abutting sides of the side wall portions 26*b*, 26*c* and the rear wall portion 78. As such, the flexible integral hinge 70 is formed between the cover 30 and the rear wall portion 26*d* which are formed from the continuous piece of material. The first and second zipper segments 60,64 are attached to the cover 30 and upper edges 34 of the walls 26*a*, 26*b*, 26*c*, respectively. The first and second zipper segments 60,64 are attached to the cover and edges 30,34 so that radiused corners 79 are formed at the wall radius corners 78. By providing radiused zipper segments 60,64 at the wall radiuses 78, the teeth of the zipper segments 60,64 more easily engage while turning the corner at the wall radiuses 78. In contrast, if the wall radiuses were generally sharp right angles, the zipper teeth would tend to not engage and be more easily disengaged.

In use, the present invention comprises the thermally insulating carrier 20 which includes primarily the flexible container portion 22 and the hollow liner member 24. The flexible container portion 22 includes a compartment 32 defined by the wall portion 26, base portion 28, and cover portion 30. The liner member 24 is removably disposable inside of the compartment 32.

The liner member 24 adds structural support to the flexible container portion 22 for protecting the contents of the carrier 20. The liner 24 is formed of a waterproof, unbreakable, puncture resistant, and generally rigid, plastic material as a single piece integral body. The waterproof characteristics protect the container portion 22 from the effects of moisture as well as providing enhanced thermal properties. Due to the integral construction of the liner 24 and the removability of the liner 24 from the container portion 22, the liner 24 prevents accumulation of food and other particulate matter in the flexible container portion 20. Additionally, a curved corner 56 is formed between the liner sides 36 and the liner base 38 thereby eliminating any crevices 52, which might otherwise accumulate food and particulate matter, from the inside surface contacting the items placed in the carrier 20.

While a preferred embodiment of the present invention is shown and described, it is envisioned that those skilled in the art may devise various modifications of the present invention without departing from the spirit and scope of the appended claims. The invention is not intended to be limited by the foregoing disclosure.

The invention claimed is:

1. A thermally insulating carrier for preventing temperature change of heated or cooled items placed therein, said carrier comprising:

a flexible container portion and a generally rigid hollow liner member removably positioned inside said flexible container portion;

said flexible container portion including a bottom portion and a walled portion attached thereto, said attached walled portion and bottom portion defining a compartment in said flexible thermally insulating carrier, a top edge of said walled portion defining a container aperture, a cover member displaceably overlying said container aperture, said walled portion includes at least a front surface and a rear surface, said front surface being attached to said bottom portion, said rear surface being integrally formed with said bottom portion and said cover, an integral hinge being formed between said rear surface and said cover, said container aperture being defined along a top edge of said front surface walled portion and said integral hinge;

zipper means cooperatively attached to said walled portion and said cover for releasably retaining said cover to said walled portion, a first zipper segment of said zipper means attached to said cover, a second zipper segment of said zipper means attached to said top edge of said front surface;

said hollow liner being formed as a single piece unitary body of a plastic material, said liner including upright wall portions and an integrally formed bottom portion, a concave corner joining said bottom portion and said wall portions for preventing accumulation of debris in said liner, a mouth on said liner for receiving items therethrough, said mouth and said container aperture being coincident, an outwardly extending lip portion formed along a top edge of said upright walls at said mouth for overlying said top edge of said walled portion, reinforcing said upright wall portions of said tub-like member and preventing material from becoming disposed between an inside surface of said flexible container and an outside surface of said hollow liner, said hollow liner being formed of a rigid and waterproof material and positioned inside of said compartment for improving the thermal characteristics, providing structural support for said container portion, and preventing leakage of moisture from said container portion.

2. A thermally insulating carrier as recited in claim 1, wherein said cover has a bottom side facing inwardly towards said compartment when said cover is positioned thereover, a top side of said cover on a side of said cover opposite said bottom side, said second zipper segment of said zipper means being attached to said cover between said bottom side and said top side for cooperative engaging said first zipper segment.

3. A thermally insulating carrier for preventing temperature change of heated or cooled items placed therein, said carrier comprising:

a flexible container portion and a hollow liner member removably positioned inside said flexible container portion;

said flexible container portion including a bottom, four wall portions attached thereto and a cover; said bottom, cover, and four walls defining a compartment in said flexible thermally insulating carrier; said carrier being defined by first and second pieces of material which are assembled to form a generally cubic structure, said first piece comprising left, right and front walls of said four walls, said second piece comprising said bottom, a rear wall, and said cover; said second piece attached to said first piece along bottom edges of said front, left, and right walls attached to corresponding edges of said bottom, said rear wall of said first piece attached to said second piece along corresponding edges of said left and right walls;

a top edge of said second piece defining a container aperture, said cover removably overlying said container aperture, an integral hinge being formed between said rear wall and said cover, said closing means extending along a top edge of said front surface for retaining said cover over said container aperture;

closing means cooperatively attached to said walled portion and said cover for releasably retaining said cover to said walled portion, a first segment of said closing means attached to said cover, a second segment of said closing means attached to said container aperture;

said hollow liner being formed as a single piece unitary body of a plastic material, said liner including upright wall portions and an integrally formed bottom portion joined with said upright wall portions at generally right angles, a concave corner being formed between said bottom portion and said wall portions for preventing accumulation of debris in said liner, a mouth on said liner for receiving items therethrough, said mouth and said container aperture being coincident, an outwardly extending lip portion formed along a top edge of said upright walls for overlying said top edge of said walled portion and adding strength to said tub-like member and preventing material from becoming disposed between an inside surface of said flexible container and an outside surface of said hollow liner, said hollow liner being formed of a generally rigid and waterproof material and positioned inside said compartment for improving the thermal characteristics, providing structural support for said container portion, and preventing leakage of moisture from said container portion.

4. A thermally insulating carrier for preventing temperature change of heated or cooled items placed therein, said carrier comprising:

a flexible container portion and a rigid, hollow liner member disposed inside said flexible container portion; said flexible container portion including a bottom portion and a walled portion attached thereto, said walled portion defining a front wall and two side walls, each of said side walls depending from opposite sides of said front wall, said bottom portion including a base, a rear wall, and a cover, each of said bottom portion and walled portion being formed of a unitary member, said walled portion having an upper edge defined by a continuous edge of said front wall and said depending side walls, and a bottom edge defined along an edge of said front wall and depending side walls opposite said top edge, said base being attached to said bottom edge of said walled portion, said rear wall being attached at spaced apart locations to spaced apart edges of said depending side walls, an integral hinge being defined between said rear wall and said cover of said unitary bottom portion, an inside surface of said bottom portion and said walled portion defining a compartment therein;

zipper means cooperatively attached to said walled portion and said cover for releasably retaining said cover to said walled portion, a first zipper segment of said zipper means attached to an edge of said cover corresponding to said top edge of said walled portion, a second zipper segment of said zipper means attached to said top edge of said walled portion for cooperative engaging said first zipper segment to retain said cover over said compartment;

radiused corners between said front wall and each of said two side walls, said radiused corners defining arcuate portions of said top edge of said walled portion, said second zipper segment of said zipper means being attached to said top edge and defining arcuate portions of said second zipper segment along said radiused portions of said top edge, said first zipper segment being attached to said cover and defining cover radiused portions of said first zipper segment for cooperative engagement with said arcuate portion of said second zipper segment;

said hollow liner being formed as a single piece unitary body of a plastic material, said liner including upright wall portions and an integrally formed bottom portion, intersecting corners of said bottom portion and said walled portions defining concave radiused surfaces for preventing accumulation of debris in said liner, said wall portions of said liner defining a mouth for receiving items therethrough, said mouth of said liner and said container aperture being coincident, an outwardly extending lip portion formed along an upper edge of said wall portions of said liner, said walls of said liner having a dimension for positioning said extending lip overlying said top edge of said walled portion of said flexible container, said overlying lip portion reinforcing said upright wall portions of said liner and preventing material from becoming disposed between an inside surface of said flexible container and an outside surface of said liner, said liner being formed of a rigid, waterproof material.

5. An insulating carrier as recited in claim 4, wherein said bottom portion and said walled portion include an outer layer of abrasion-resistant material attached at a perimeter thereof to a water-resistant thermal barrier material, a layer of insulating material being retained between said outer layer and said water-resistant thermal barrier, said outer layer of said walled and bottom portions defining an exterior surface of said insulating carrier and said water-resistant thermal barrier defining an internal surface of said insulating carrier.

* * * * *